United States Patent [19]

Slosberg et al.

[11] Patent Number: 4,689,258

[45] Date of Patent: Aug. 25, 1987

[54] FLOOR MAT AND METHOD OF MANUFACTURE

[75] Inventors: David K. Slosberg, Atlanta; Gilbert S. Nowell, Marietta, both of Ga.

[73] Assignee: Compo Industries, Inc., Waltham, Mass.

[21] Appl. No.: 903,387

[22] Filed: Sep. 3, 1986

[51] Int. Cl.[4] ..... D04H 1/58; B32B 3/00

[52] U.S. Cl. ..... 428/141; 427/243; 427/244; 428/288; 428/290; 428/296; 428/297

[58] Field of Search ..... 427/243, 244; 428/141, 428/288, 290, 296, 297

[56] References Cited

U.S. PATENT DOCUMENTS

| | | | |
|---|---|---|---|
| 3,687,759 | 8/1972 | Werner et al. | 156/167 |
| 3,691,004 | 9/1972 | Werner et al. | 428/246 |
| 4,104,435 | 8/1978 | Ballesteros | 427/244 |
| 4,252,590 | 2/1981 | Rasen et al. | 156/167 |
| 4,342,807 | 8/1982 | Rasen et al. | 428/288 |
| 4,438,172 | 3/1984 | Katsutoshi et al. | 428/288 |
| 4,481,248 | 11/1984 | Fraige | 427/243 |
| 4,515,854 | 5/1985 | Kogame et al. | 428/288 |
| 4,550,050 | 10/1985 | Buck, Jr. | 428/288 |
| 4,565,735 | 1/1986 | Murka, Jr. et al. | 428/288 |

OTHER PUBLICATIONS

Lightweight 3-Dimensional Geomatrix Matting for Heavyweight Construction Needs, American Enka Co., 1985, 4 pages.

New Cushion Flooring, American Enka Co., (no date), 6 pages.

Soil Engineering with Fibers, American Enka Co., (no date), 4 pages.

Enkamat, Soil Reinforcing Matting, American Enka Co., (no date), 4 pages.

*Primary Examiner*—William J. Van Balen

*Attorney, Agent, or Firm*—Richard P. Crowley

[57] ABSTRACT

A resilient, abrasion-resistant foraminous surface covering material, such as a floor mat, which mat comprises a layer composed of a plurality of relatively stiff, resilient fibers, each fiber intersect with one another. The fiber is coated with a high density, polymeric foam material. When surface of the coated fibrous material having a plurality of irregular islands of polymers with lower surface form a generally planar gripping surface, and the other top surface, characterized by a discontinuous, irregular surface, the coated, fibrous material having a relatively large, open area therethrough to permit the drainage of liquids through the surface coating covering material.

15 Claims, 9 Drawing Figures

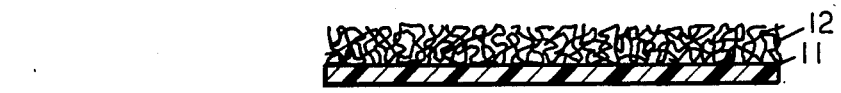
FIG. 1 - PRIOR ART
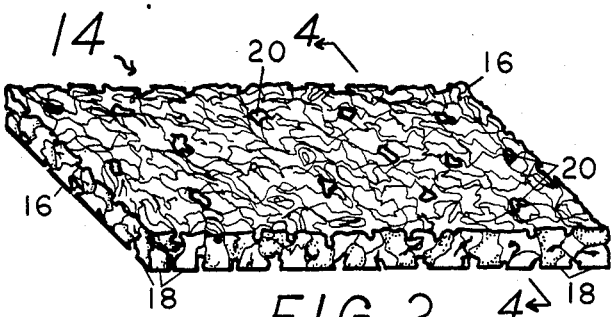
FIG. 2
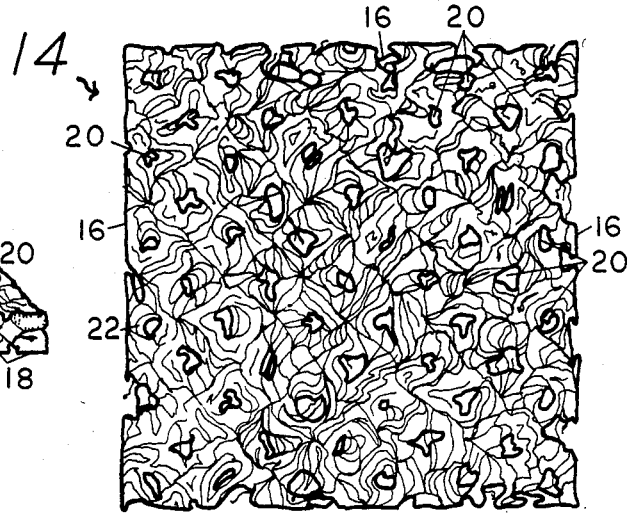
FIG. 3
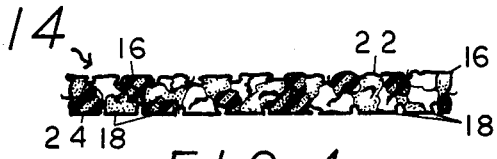
FIG. 4
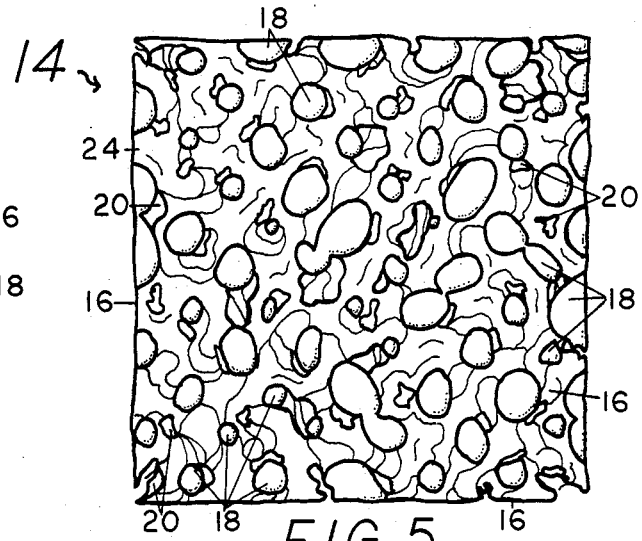
FIG. 5

FLOOR MAT AND METHOD OF MANUFACTURE

BACKGROUND OF THE INVENTION

Surface covering material is typically comprised of a top wear surface and a bottom surface. Surface covering materials would include floor mats and runners. Such mats and runners may also be used as a surface-cushioning and shock-absorbing material.

One surface covering material particularly employed in barns and veterinary cages is known as Cow Cushion® (a trademark of the American Enka Company, Inc.) These floor mats are composed of a three-dimensional layer of a stiff, melt-spun extruded nylon filament fibrous material wherein the fibers form a three-dimensional, peak-and-valley structure. The material comprises a randomly disposed, non-woven layer and forms a highly irregular, discontinuous mass of very open filaments melt-bonded at the filament intersections. The mat has a solid vinyl plastisol surface which may have fibrous material, like a polyester fabric, thereon. The mats are employed in barns and in veterinary cages, the solid surface being the wear-resistant face surface stood upon by the animals and being spaced apart from the floor surface of the barn or veterinary cage by the nylon fibrous fibers in the lower section of the mat. Such mats are useful in that the surface of the barn or the veterinary cage may be washed down with water to remove animal feces and urine.

The three-dimensional nylon filament material is known as Enkamat® (a trademark of the American Enka Company, Inc.) and is also employed as a reinforcement, soil restraining and drainage mat (see for example U.S. Pat. No. 3,866,352 issued Feb. 18, 1975). Such mats are formed of filaments of melt-spun polymeric particularly thermoplastic synthetic fiber, randomly melt-bonded at the filament intersections to form a very open, typically over about 90%, three-dimensional structure which has a peak-and-valley structure. The mats generally have a filament diameter of 0.1 mm to 1.5 mm for a pliable, resilient, crush-resistant fibrous mat structure. These mats and the process of producing such mats are described in U.S. Pats. Nos. 3,691,004, 3,687,759, 4,252,590 and 4,342,807, all incorporated herein by reference in their entirety.

It is desirable to provide a resilient, wear-resistant foraminous surface covering material which provides for a wear-resistant top and providing a bottom gripping surface which is open in nature to permit the drainage of liquid therethrough either for cleaning purposes or for melting of snow where a surface material is employed as a floor mat or runner.

SUMMARY OF THE INVENTION

The invention relates to a surface covering material and to a method of preparing and using the material. In particular, the invention concerns a resilient, foraminous floor mat and a method of preparing and using the floor mat.

A surface covering material has been discovered which is a resilient, abrasion-resistant, foraminous surface covering material which material allows a liquid, such as water, to run easily therethrough and which material is light and flexible, and yet presents an open, efficient, dirt-collecting, wear-resistant face surface and a lower surface of greater surface area than the top surface. The surface material replaces a flat, solid material as a wear-resistant face without employing the same amount of plastic material. The surface covering comprises an open, fibrous, synthetic mesh material in which the filaments or fibers have been coated with a polymer to present an irregular open, discontinuous, wear-resistant face surface and a lower open gripping surface. The surface covering material finds particular use as a floor mat or runner material and as cushioning material.

The surface coating material has a significantly open or foraminous, porous structure. It has an open, wear-resistant surface with a reduced tendency to snag, for example, with the wiping of the shoes thereon to remove dirt, soil, snow and the like. The foraminous nature of the surface coating materials permit the material to be easily cleaned by washing with a hose, and yet the structure is such that moisture and dirt is not trapped permanently within the material. The surface coating material may be employed as an artificial playing surface, as an anti-fatigue surface or as a shock-absorbing or cushioning material or for other uses. It may be particularly used where the drainage of a liquid, such as water, is desired such as in a shower stall, a barn or for veterinary use where rapid drainage through the surface covering material is desirable. The mat has significant enhancing, load-bearing characteristics due to the combination of the formable vinyl coating and the resilience of the original mat, and thus may be employed when load-bearing properties are desired.

The surface covering material comprises a layer of a resilient, mesh-like synthetic fibrous material which is composed of woven or non-woven, randomly-disposed filaments or fibers, typically melt spun, and polymeric fibers such as nylon, with the layer material being pliable and resilient in nature. The layer material may vary in thickness and be of varying stiffness, typically, for example, may be comprised of a randomly-disposed, extruded polymeric such as nylon fibrous material in a signifcantly open structure, such as the Enkamat® material. The extruded fibers are in contact and intersecting to form a highly open, irregular mesh and discontinuous mass of fibrous material. It is flexible and readily available in roll form.

The covering material includes the layer of fibers wherein the fibers have been coating with a polymeric material, either solid or particularly foam, such as a solid or high-density foam vinyl chloride resin material which forms a resilient, abrasion-resistant coating thereon to coat all of the fibers and provide for a polymeric build-up on the points of bonded intersections of the fibers, since the intersections of the fibers tend to trap more material than the body of the fibers so that the resulting surface coating material comprises a very open, but random, structure.

The surface of the covering material is characterized by a generally planar surface composed of a plurality of irregular, typically rounded, polymeric materials which form conical or pyramidal-type islands to provide a greater gripping or contact surface area of polymeric material on the bottom surface than on the top surface of the covering. The bottom surface of the polymeric islands act as a friction or gripping surface for the surface covering. The opposite, or generally the top surface, is characterized by an irregular, discontinuous, broken, abrasion-resistant surface which serves as the top surface. The surface coating is characterized by a substantial foraminoustype structure which permits the flow of liquid therethrough to provide for the rapid drainage of liquid, typically wherein the open surface area is greater than 25% of the total surface area of top surface of the covering and typically 30% to 50%.

The surface covering is prepared by coating the open mesh, fibrous material with a polymeric material. And after coating, the material is placed onto a planar surface such as a release paper or an endless belt such as a glass fiber belt coated with a fluorocarbon resin. Upon heating the coated polymeric material, typically where the polymeric material is composed of a vinyl resin plastisol and depending on the viscosity, a plurality of irregular, typically round feet or spotting of the polymeric material occurs on the pressure-release support surface. However, the material remains significantly open and porous. Generally, in order to provide a resilient-type material, the polymeric material comprises a high-density-type foam material, such as a material having over 20 or 25 pounds per cubic foot foam density. More typically, the polymeric material may comprise a variety of polymers, such as urethane polymers, but generally composed of a vinyl halide polymer, such as a vinyl chloride copolymer or homopolymer material, is applied to the material in a liquid organosol or plastisol form, and after coating, heated to fuse the vinyl plastisol material. The selected coating polymer should bond to the polymeric filaments of the mat.

A layer of fibrous material is coated with the polymeric liquid by dipping, spraying or coating or otherwise contacting the layer of fibrous material so as to coat the fibers and also to provide for some accumulation of the liquid polymeric material at the fibrous intersections. Generally, depending on viscosity of the liquid polymer material, excess material runs down and forms a smooth, but discontinuous, surface on the one or lower side to form a plurality of islands having a generally planar surface against the pressure-release surface. The mesh-type material employed, such as the extruded nylon filament material, typically has a melting point considerably above that of the fusion point of the liquid polymeric material used, such as a vinyl plastisol. For example, the extruded nylon, non-woven material has a melting point of 400° F. or above, but a vinyl plastisol is generally fused at temperatures of 275° F. to 350° F., so that the extruded nylon material may be coated with a vinyl plastisol, the vinyl plastisol accumulating at the fiber intersections and also forming islands against the pressure-release surface and being fused without affecting the resilient nature of the nylon filament fibers forming the mat layer.

The thickness of the floor mat may vary, and typically it ranges from one-quarter inch to one inch, while the stiffness of the material may vary depending upon the nature of the fibrous material and whether a solid or foam polymeric material is employed in the coating. In one preferred embodiment, the fibrous material is composed of a melt-extruded, synthetic, polymeric, thermoplastic material, melt-bonded at the fiber intersections, such as a non-woven, randomly exposed, extruded nylon fibers, which forms a very open mesh-type material, and which nylon fibers have been coated with a high density, foamable vinyl plastisol. After coating, the layer is placed on a pressure-release or flat surface and then the vinyl plastisol fused by heating in an oven to form the foraminous surface coating. While a variety of liquid coating polymers may be employed, including the polyolefins, such as polyethylene, polypropylene and others synthetic polymers, such as urethane, vinyl chloride resins are preferred, both for wear resistance and crushability, since some urethanes are typically moisture sensitive and may tend to oxidize with time.

The invention will be described for the purposes of illustration only in connection with an embodiment; however, it is recognized that a person skilled in the art may make various modifications, changes and improvements in the illustrated embodiment, all falling within the spirit and scope of the invention.

BRIEF DESCRIPTION OF THE DRAWINGS

FIG. 1 is a side sectional view of a prior art surface coating material;

FIG. 2 is a perspective view of the surface coating material of the invention;

FIG. 3 is a plan top view of the surface coating material of FIG. 2;

FIG. 4 is a side sectional view along line 4.4 of FIG. 2 of the surface coating material of FIG. 1;

FIG. 5 is a bottom plan view of the surface coating material of FIG. 1.

DESCRIPTION OF THE EMBODIMENTS

Figure 6:
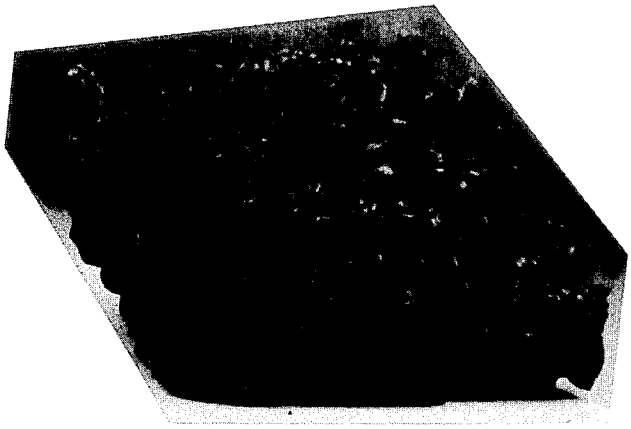
FIGS. 6–9 are photographs of plan views in FIGS. 2–5 of a high density, vinyl foam mat of the invention.

FIG. 1 shows a prior art surface covering 10 used in barns and veterinary cages wherein the mat 10 comprises a solid top surface coating 11 composed of a vinyl chloride resin securely bonded to a lower, much thicker, layer of an extruded nylon, open mesh, non-woven filament or fibrous material 12. Optionally, but not shown, the top surface of the solid vinyl chloride layer 11 may also have a fabric or fibrous top surface. The surface covering 10 is usually employed in barns and veterinary cages since the top surface layer 11 is spaced apart by the open mesh, resilient, extruded nylon 12 from the floor surface, and the surface covering may be washed with water into the open lower layer 12. The prior art surface covering 10 is produced by casting a vinyl chloride plastisol layer onto a pressure-release surface, either paper or an endless fluorocarbon belt, applying the pliable extruded nylon, open mesh layer 12 onto the liquid plastisol layer, then heat fusing the surface of the plastisol in an oven to the nylon mesh layer.

FIGS. 2–5 as directed to the surface covering 14 of the invention, in which an extruded nylon 6, randomly disposed, open-mesh layer 12, as shown in FIG. 1 (known as Enkamat®, a trademark of American Enka Company, Inc.), has been coated with a high density, vinyl chloride plastisol as a polymeric coating 16 which forms a high density, polyvinyl foam layer, e.g. 25 to 40 pounds per cubic foot. The lower surface is composed of a plurality of irregular islands 18 composed of the vinyl chloride with the surface covering 14 having substantial open areas 20 on the top surface 22 and also on the bottom surface 24. As illustrated, the top surface 22 is an irregular, discontinuous, open, peak-and-valley type surface which forms a wear-resistant top surface, and wherein the bottom surface 24 has a plurality of the vinyl chloride islands of irregular size and shape, which constrict somewhat the open area of the lower surface of the covering 14. The islands 18 are formed by the vinyl plastisol draining onto the lower release surface during the construction of the surface covering 14 and prior to heating the vinyl plastisol to blow and fuse the vinyl plastisol. The high density vinyl plastisol layer congregates more at the intersections of the extruded nylon fibers, but also coats the nylon fibers to form a surface coating 14 which is resilient, abrasion-resistant and foraminous.

The drawings illustrate a resilient, abrasion-resistant, foraminous surface covering composed of a layer of a resilient, extruded nylon fiber material which has been coated more thickly at the intersections of the fibers than the fibers with a high density vinyl chloride foam material, in which the high density foam material forms a generally planar surface formed of conicaltype islands with a planar base surface on the bottom surface 24 and has an open, irregular, discontinuous top surface 22, the open area generally 40% to 50% or more than the bottom surface. The surface covering material 14 presents a wear-resistant surface and a bottom island gripping surface which can be easily cleaned by applying water which washes through the surface covering.

Figure 7:
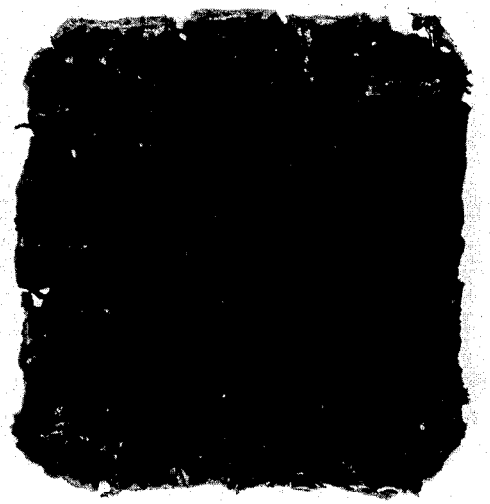
Figure 8:
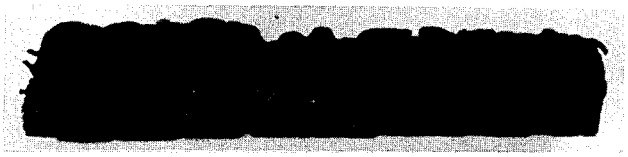
Figure 9:
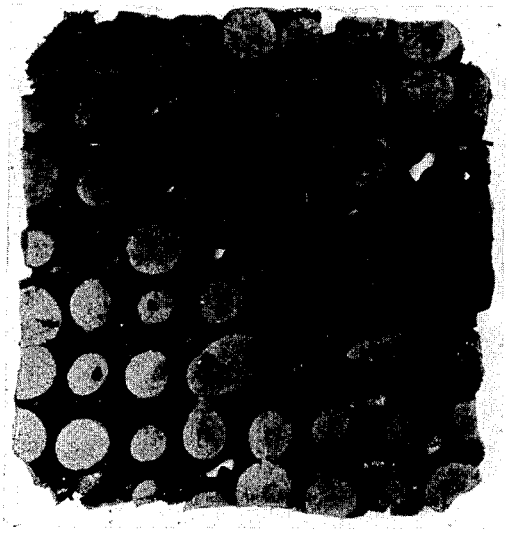

The photographs FIGS. 6–9 are of a sample mat produced by dipping a nylon Enkamat® mesh layer into a foamable vinyl resin plastisol, placing the dipped layer onto a paper release surface, heating the vinyl contact mat to form and fuse this vinyl plastisol to form a high density foam mat with a mat thickness of about 0.400 inches.

The mat is generally prepared by merely contacting the pliable, open-mesh material, such as by immersing an inner layer of the open-mesh, extruded nylon, fibrous material into a vinyl chloride plastisol of selected viscosity so as to coat the entire mesh layer; thereafter, placing the mesh layer onto a release surface such as release-surface coated paper or onto the surface of an endless belt, and then passing the coated nylon fibrous layer so coated through a hot air oven, thus subjecting the coated layer to heat to a temperature of about 250° F. to 375° F. sufficient to blow and fuse the liquid vinyl plastisol. Prior to the fusion step, the vinyl plastisol tends to migrate towards the fiber intersections of the fibers, so that the intersections of the fibrous layer tend to accumulate more vinyl plastisol than the coated nylon fibers, while further the vinyl plastisol tends to drain toward the lower surface and to form small puddles or pools against the release surface, so that on fusing, the polymeric islands are formed to provide a bottom planar gripping surface on the bottom surface of the mat which has a greater surface area than the open, top surface. The amount and nature of the islands forming the lower gripping surface may vary depending on how long a period of time that the coated layer is left on the release paper or endless belt and the viscosity of the particular vinyl plastisol employed, e.g. 2000 to 5000 cps at 25° C. The viscosity of the vinyl plastisol and the time on the surface should not be sufficient to permit the vinyl plastisol to form a completely enclosed coating on the lower surface since the nature of the surface mat should be as such to provide for substantial open area throughout the depth of the coated nylon fiber area.

What is claimed is:

1. A resilient, abrasion-resistant, foraminous surface covering material, which material comprises:

(a) a layer of a pliable, resilient, mesh-like, three-dimensional synthetic polymer fibrous material wherein the fibers intersect;

(b) an abrasion-resistant, polymeric material coated on a fibrous material and gathered at the intersections of the fibers;

(c) one surface of the polymeric-coated fibrous material characterized by a generally planar surface composed of a plurality of generally irregularly-formed polymeric islands, and the opposite surface of the surface coated material characterized by a generally discontinuous, open, broken irregular surface; the one surface forming a greater surface area than the other surface; and (d) the surface covering material characterized by a substantially foraminous structure throughout the depth so as to permit the flow of liquid therethrough.

2. The surface covering of claim 1 wherein the fibrous material comprises a melt-extruded, randomly disposed, non-woven thermoplastic fibrous material melt-bonded at the fiber intersections.

3. The surface covering of claim 2 wherein the fibrous material is composed of nylon having a melting temperature greater than about 400° F.

4. The surface covering of claim 1 wherein the fibrous material comprises an extruded, open mesh, nylon fibrous material.

5. The surface covering of claim 1 wherein the coated polymeric material comprises a high density foam polymeric material having a foam density of greater than about 20 pounds per cubic foot.

6. The surface covering of claim 5 wherein the high density foam material comprises a vinyl chloride foam material.

7. The surface covering of claim 1 wherein the generally planar surface of the polymeric island comprises greater than about 25% but less than about 75% of the planar surface.

8. The surface covering of claim 1 wherein the islands on the one surface have a general conical shape and a planar bottom surface.

9. A resilient, abrasion-resistant, foraminous surface covering material, which material comprises:

(a) a three-dimensional layer composed of a plurality of resilient, pliable, mesh-like, randomly disposed, melt-extruded thermoplastic fibrous material, the fibrous material intersecting throughout the layer in a random manner, the fibers melt-bonded at the intersections;

(b) the fibrous material coated with a high density foam vinyl chloride polymer and having the high density foam vinyl chloride polymer gathered at the intersections of the fibers;

(c) the one surface of the coated fibrous material having a plurality of irregular islands composed of the high density, vinyl-coated foam material whose lower surface forms a generally planar gripping surface for the surface covering material;

(d) the other top surface characterized by an irregular, discontinuous, open, wear-resistant surface; and (e) the surface covering material having an open area therethrough, to permit the drainage of liquid therethrough, the open area comprising at least 25% or greater of the surface area of the one surface.

10. The surface covering of claim 9 wherein the fibrous material comprises a nylon, melt-extruded fiber.

11. The method of preparing a resilient, abrasion-resistant, foraminous surface covering material, which method comprises:

(a) contacting a three-dimensional layer of an open, mesh-like pliable, resilient, synthetic polymer fibrous material with a liquid polymeric material to coat the fibrous material with the liquid polymeric material;

(b) permitting the liquid polymeric material to gather at the fibrous intersections of the fibrous material and placing the contacted fibrous material onto a polymer release support surface and permitting the liquid polymeric material to drain downwardly to form a plurality of pooled, liquid polymeric materials against the release support surface;

(c) heating the contacted fibrous material to form a polymeric coating on the fibrous material and the polymer at the fiber intersections and the polymer drained against the release surface; and (d) removing the contacted fibrous material containing the solid polymeric material coated thereon from the release surface, recovering a surface covering material.

12. The method of claim 11 wherein the mesh-like, resilient fibrous material comprises a non-woven, melt-extruded and bonded nylon fibrous material having a thickness of about one-quarter inch to about one inch.

13. The method of claim 11 wherein the liquid polymeric material comprises a liquid vinyl resin plastisol material.

14. The method of claim 11 wherein the liquid polymeric material comprises a foamable liquid vinyl chloride plastisol material wherein upon heating the contacted fibrous material, a high density polyvinyl chloride foam having a density of greater than about 20 pounds per cubic foot is formed.

15. The method of claim 11 includes employing a vinyl resin plastisol material as the liquid polymeric material, the vinyl plastisol having a viscosity of about 2000 to 6000 cps at 25° C., permitting the fibrous material coated with the liquid vinyl plastisol to drain while on the supporting release surface for a sufficient period of time to provide a lower area composed of about greater than 25% but not greater than about 75% of vinyl plastisol islands against the release surface.

* * * * *